US008469863B2

(12) United States Patent
Wang

(10) Patent No.: US 8,469,863 B2
(45) Date of Patent: Jun. 25, 2013

(54) REHABILITATION EXERCISING EQUIPMENT THAT CAN EXTEND A USER'S ARMS

(75) Inventor: Shih-Jung Wang, Taiping (TW)

(73) Assignee: Preventive Medical Health Care Co., Ltd., Taoyuan County (TW)

( * ) Notice: Subject to any disclaimer, the term of this patent is extended or adjusted under 35 U.S.C. 154(b) by 202 days.

(21) Appl. No.: 13/170,472

(22) Filed: Jun. 28, 2011

(65) Prior Publication Data

US 2013/0005539 A1 Jan. 3, 2013

(51) Int. Cl.
*A63B 22/00* (2006.01)
*A63B 22/12* (2006.01)

(52) U.S. Cl.
USPC ..... 482/51; 482/62

(58) Field of Classification Search
USPC ..... 482/51–52, 57, 62–63, 92, 133–138, 482/148; 601/23, 35–36
See application file for complete search history.

(56) References Cited

U.S. PATENT DOCUMENTS 6,004,244 A * 12/1999 Simonson ..... 482/52
6,852,070 B1 * 2/2005 Herbert ..... 482/57
7,530,932 B2 * 5/2009 Lofgren et al. ..... 482/62
7,594,877 B2 * 9/2009 Anderson et al. ..... 482/52

* cited by examiner

*Primary Examiner* — Loan Thanh
*Assistant Examiner* — Jennifer Deichl
(74) *Attorney, Agent, or Firm* — Alan Kamrath; Kamrath IP Lawfirm, P.A.

(57) ABSTRACT

A rehabilitation exercising equipment includes a main frame, a first geared member rotatably mounted on the main frame, a second geared member rotatably mounted on the main frame, a connecting mechanism mounted between the first geared member and the second geared member, a first idle geared member rotatably mounted on the main frame and connected with the connecting mechanism, a second idle geared member rotatably mounted on the main frame and connected with the connecting mechanism, and two handlebars secured on the first geared member and the second geared member respectively. Thus, a user's two hands can hold the handlebars to pivot the handlebars in two opposite directions by connection of the connecting mechanism so as to achieve an exercising or rehabilitating function.

15 Claims, 14 Drawing Sheets

REHABILITATION EXERCISING EQUIPMENT THAT CAN EXTEND A USER'S ARMS

BACKGROUND OF THE INVENTION

1. Field of the Invention

The present invention relates to a rehabilitation equipment and, more particularly, to a rehabilitation exercising equipment.

2. Description of the Related Art

A conventional rehabilitation equipment comprises a support frame, a pedal portion mounted on the support frame, and a handle portion mounted on the support frame and connected with the pedal portion to move in concert with the pedal portion. Thus, when a user holds the handle portion and treads the pedal portion, the handle portion is driven by the pedal portion to move upward and downward so as to provide a rehabilitating function to the user's two hands. However, when the user's legs are injured, he/she cannot tread the pedal portion to drive the handle portion easily, thereby causing inconvenience to the user, and thereby decreasing the rehabilitating effect of the rehabilitation equipment.

BRIEF SUMMARY OF THE INVENTION

In accordance with the present invention, there is provided a rehabilitation exercising equipment, comprising a main frame, a first geared member rotatably mounted on the main frame, a second geared member rotatably mounted on the main frame, a connecting mechanism mounted between the first geared member and the second geared member to connect the first geared member and the second geared member so that the first geared member and the second geared member are movable in concert with each other, a first idle geared member rotatably mounted on the main frame and connected with the connecting mechanism, a second idle geared member rotatably mounted on the main frame and connected with the connecting mechanism, and two handlebars secured on the first geared member and the second geared member to rotate in concert with the first geared member and the second geared member respectively. The connecting mechanism includes a first connecting portion meshing with the first geared member, a second connecting portion meshing with the second geared member, a third connecting portion meshing with the first idle geared member and a fourth connecting portion meshing with the second idle geared member. The first connecting portion and the second connecting portion of the connecting mechanism are parallel with each other. The third connecting portion and the fourth connecting portion of the connecting mechanism are parallel with each other. Each of the third connecting portion and the fourth connecting portion of the connecting mechanism traverses and connects the first connecting portion and the second connecting portion so that the third connecting portion and the fourth connecting portion of the connecting mechanism are perpendicular to the first connecting portion and the second connecting portion.

The primary objective of the present invention is to provide a rehabilitation exercising equipment that can extend a user's arms.

According to the primary advantage of the present invention, a user's two hands can hold the two handlebars to pivot the two handlebars in two opposite directions by connection of the connecting mechanism so as to achieve an exercising or rehabilitating function.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
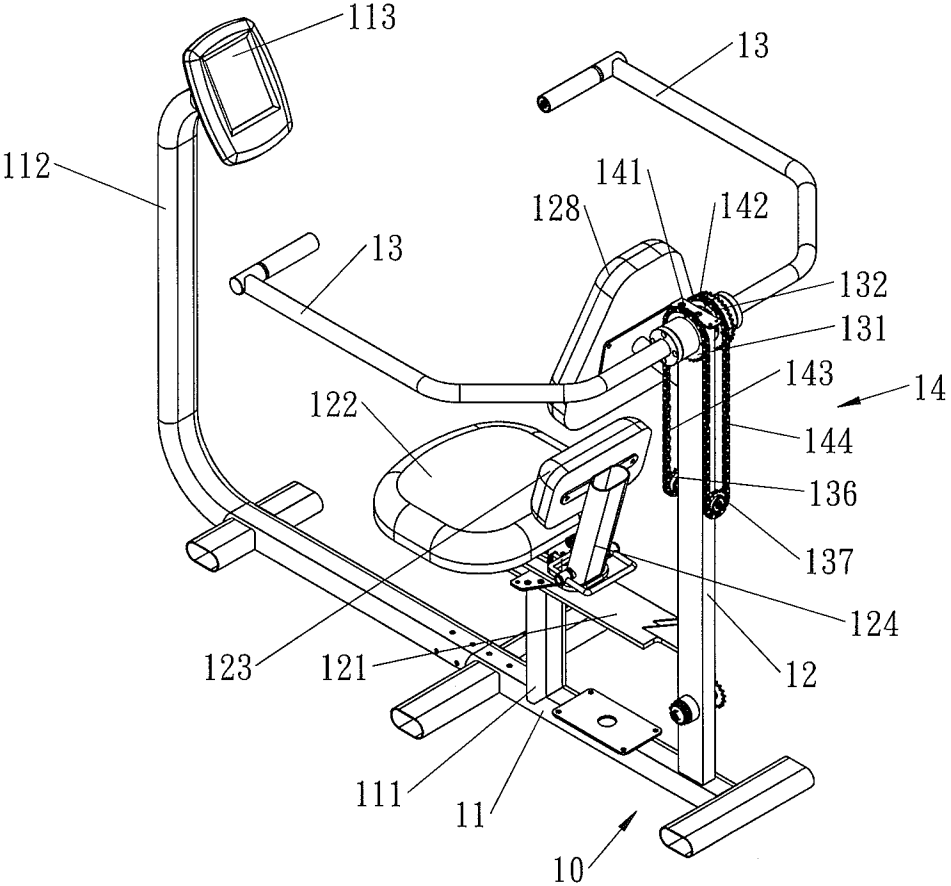
FIG. 1 is a perspective view of a rehabilitation exercising equipment in accordance with the preferred embodiment of the present invention.

Referring to the drawings and initially to FIGS. 1-11, a rehabilitation exercising equipment in accordance with the preferred embodiment of the present invention comprises a main frame 10, a first geared member 131 rotatably mounted on the main frame 10, a second geared member 132 rotatably mounted on the main frame 10, a connecting mechanism 14 mounted between the first geared member 131 and the second geared member 132 to connect the first geared member 131 and the second geared member 132 so that the first geared member 131 and the second geared member 132 are movable in concert with each other, a first idle geared member 136 rotatably mounted on the main frame 10 and connected with the connecting mechanism 14, a second idle geared member 137 rotatably mounted on the main frame 10 and connected with the connecting mechanism 14, and two handlebars 13 secured on the first geared member 131 and the second geared member 132 to rotate in concert with the first geared member 131 and the second geared member 132 respectively.

The main frame 10 includes a transverse bar 11, an upright post 12 mounted on the transverse bar 11, a support post 111 mounted on the transverse bar 11, a support plate 121 mounted between the upright post 12 and the support post 111, a seat 122 mounted on the support plate 121, a back support 124 mounted on the support plate 121, a seat back 123 mounted on the back support 124 and located above the seat 122, a back cushion 128 mounted on the upright post 12 and located above the seat back 123, an extension bar 112 connected with the transverse bar 11, and a control panel 113 mounted on the extension bar 112. The control panel 113 of the main frame 10 is preferably an electronic instrument panel.

The first geared member 131 and the second geared member 132 are rotatably mounted on the upright post 12 of the main frame 10. The first geared member 131 and the second geared member 132 are parallel with each other. Each of the two handlebars 13 is pivotally mounted on the main frame 10 and is pivoted about the upright post 12 of the main frame 10 in a curved manner. The two handlebars 13 are pivoted in two opposite directions by connection of the connecting mechanism 14.

The first idle geared member 136 and the second idle geared member 137 are rotatably mounted on the upright post 12 of the main frame 10 and are located under the first geared member 131 and the second geared member 132. The first idle geared member 136 and the second idle geared member 137 are parallel with each other. The first idle geared member 136 and the second idle geared member 137 are perpendicular to the first geared member 131 and the second geared member 132.

The connecting mechanism 14 is connected between the first geared member 131, the second geared member 132, the first idle geared member 136 and the second idle geared member 137. The connecting mechanism 14 includes a first connecting portion 141 meshing with the first geared member 131, a second connecting portion 142 meshing with the second geared member 132, a third connecting portion 143 meshing with the first idle geared member 136 and a fourth connecting portion 144 meshing with the second idle geared member 137.

The first connecting portion 141 and the second connecting portion 142 of the connecting mechanism 14 are parallel with each other. The first connecting portion 141 of the connecting mechanism 14 has a substantially inverted U-shaped profile and has two distal ends 1411. The second connecting portion 142 of the connecting mechanism 14 has a substantially inverted U-shaped profile and has two distal ends 1421.

The third connecting portion 143 and the fourth connecting portion 144 of the connecting mechanism 14 are parallel with each other. Each of the third connecting portion 143 and the fourth connecting portion 144 of the connecting mechanism 14 traverses and connects the first connecting portion 141 and the second connecting portion 142 so that the third connecting portion 143 and the fourth connecting portion 144 of the connecting mechanism 14 are perpendicular to the first connecting portion 141 and the second connecting portion 142. The third connecting portion 143 of the connecting mechanism 14 has a substantially U-shaped profile and has two distal ends 1431 pivotally connected with one of the two distal ends 1411 of the first connecting portion 141 and one of the two distal ends 1421 of the second connecting portion 142.

The fourth connecting portion 144 of the connecting mechanism 14 has a substantially U-shaped profile and has two distal ends 1441 pivotally connected with the other one of the two distal ends 1411 of the first connecting portion 141 and the other one of the two distal ends 1421 of the second connecting portion 142.

In the preferred embodiment of the present invention, the connecting mechanism 14 is a toothed belt. Alternatively, each of the first geared member 131, the second geared member 132, the first idle geared member 136 and the second idle geared member 137 is a sprocket, while the connecting mechanism 14 is a chain.

Figure 2:
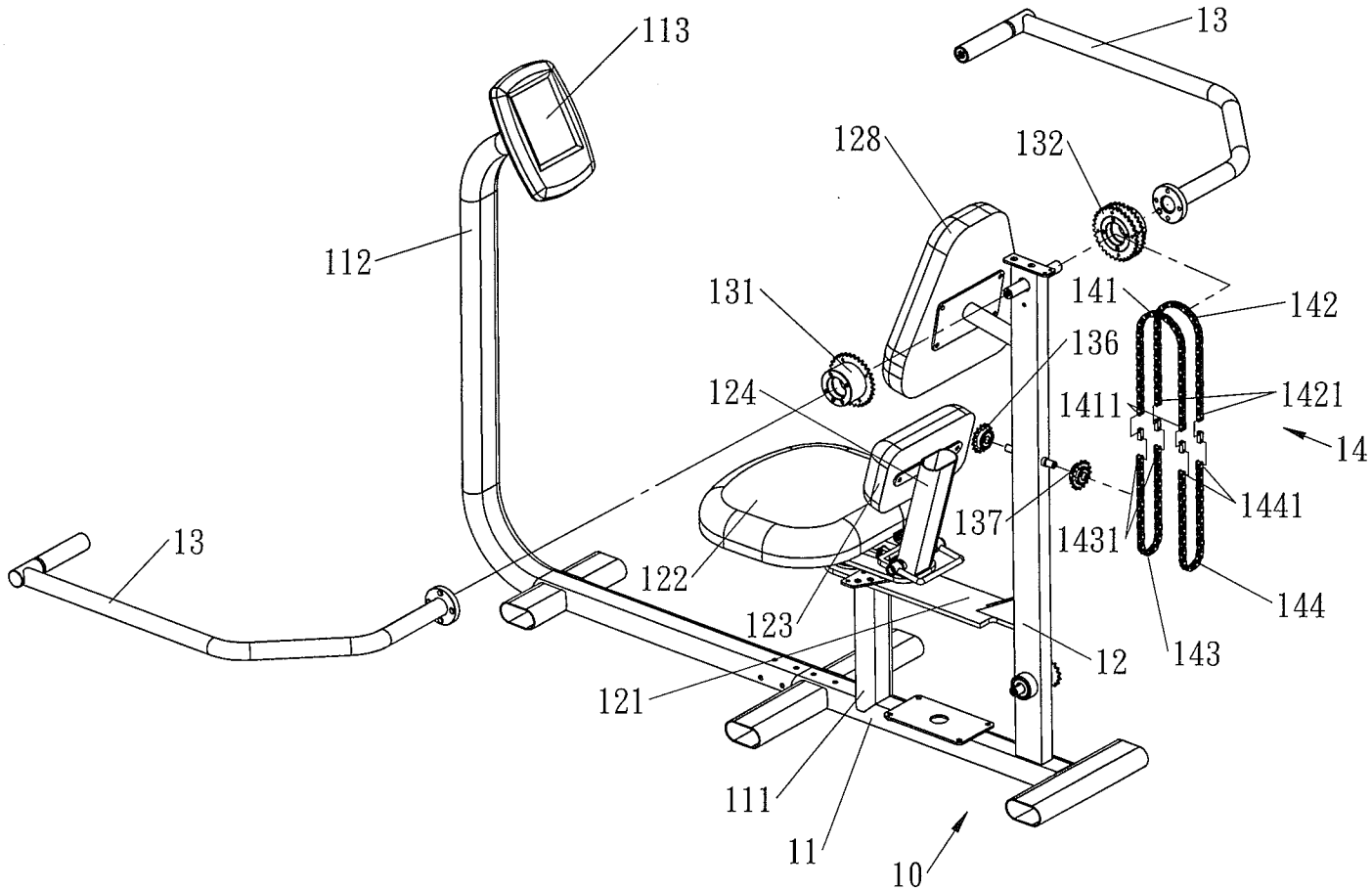
FIG. 2 is an exploded perspective view of the rehabilitation exercising equipment as shown in FIG. 1.
Figure 3:
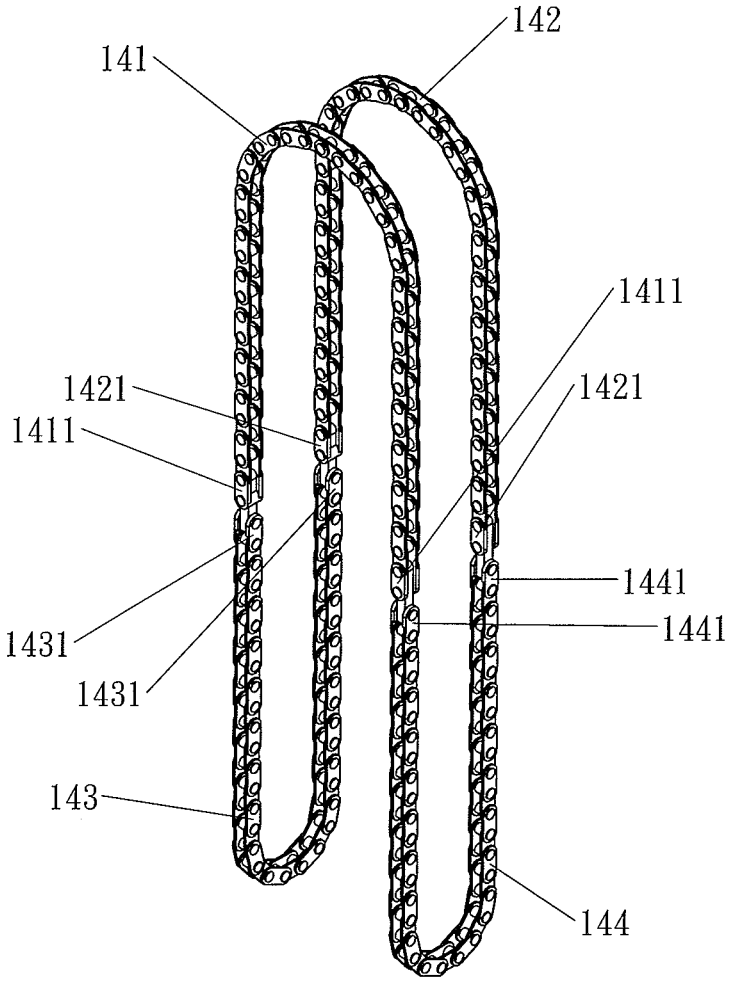
FIG. 3 is a perspective view of a connecting mechanism of the rehabilitation exercising equipment as shown in FIG. 1.
Figure 4:
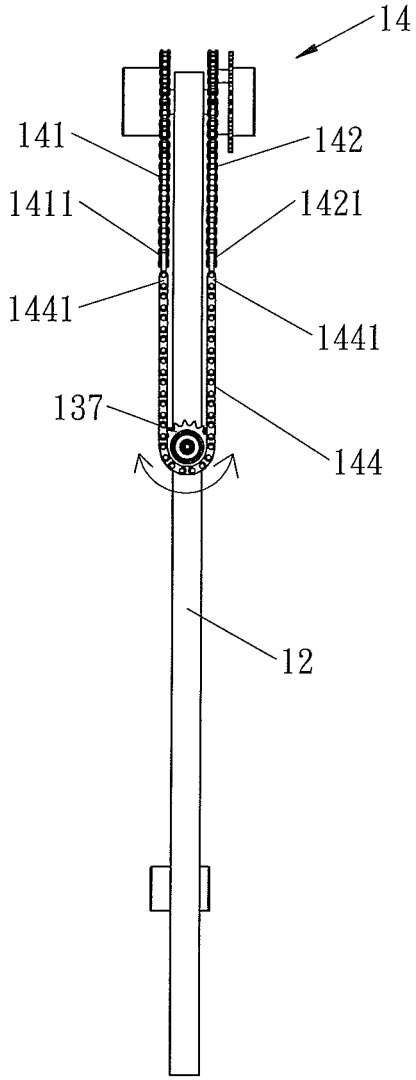
FIG. 4 is a partially side operational view of the rehabilitation exercising equipment as shown in FIG. 1.
Figure 5:
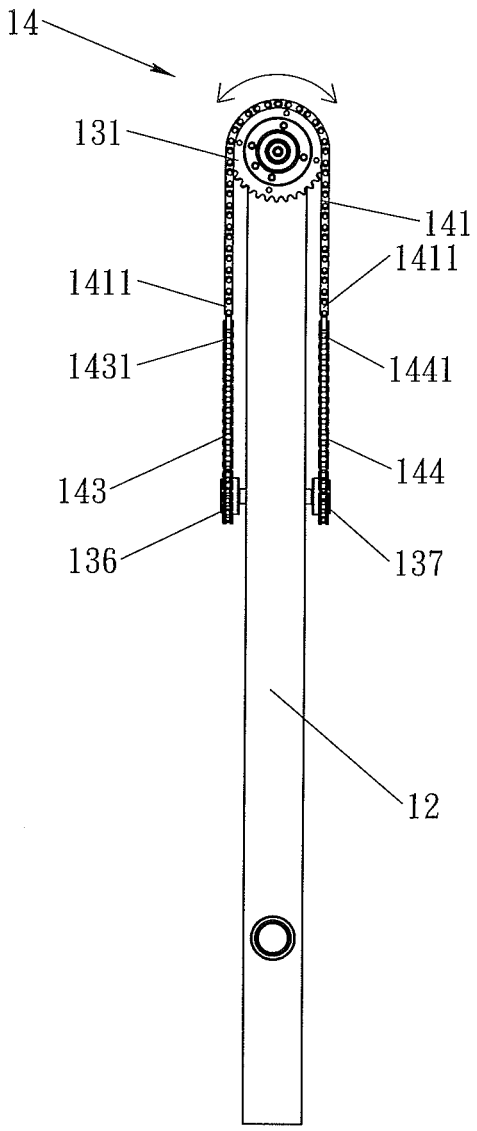
FIG. 5 is a partially front operational view of the rehabilitation exercising equipment as shown in FIG. 1.
Figure 6:
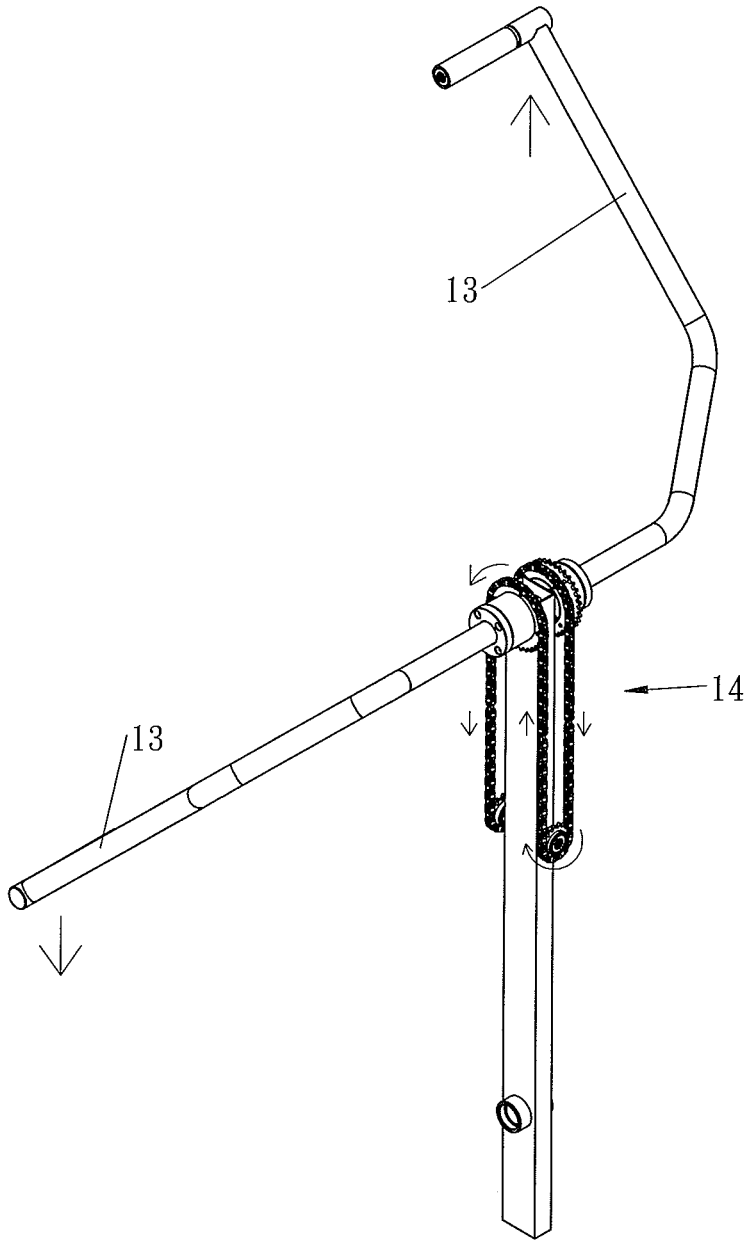
FIG. 6 is a partially perspective operational view of the rehabilitation exercising equipment as shown in FIG. 1.
Figure 7:
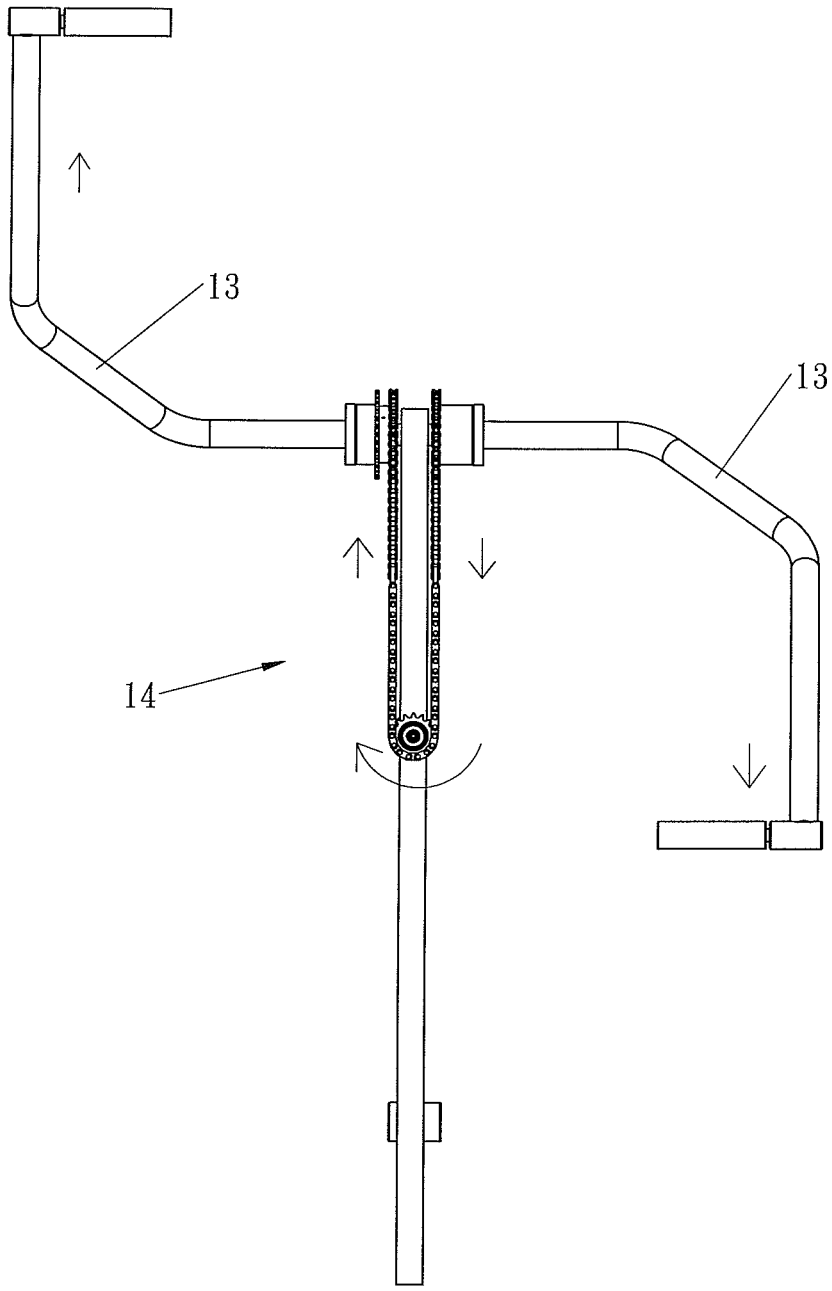
FIG. 7 is a partially side operational view of the rehabilitation exercising equipment as shown in FIG. 1.
Figure 8:
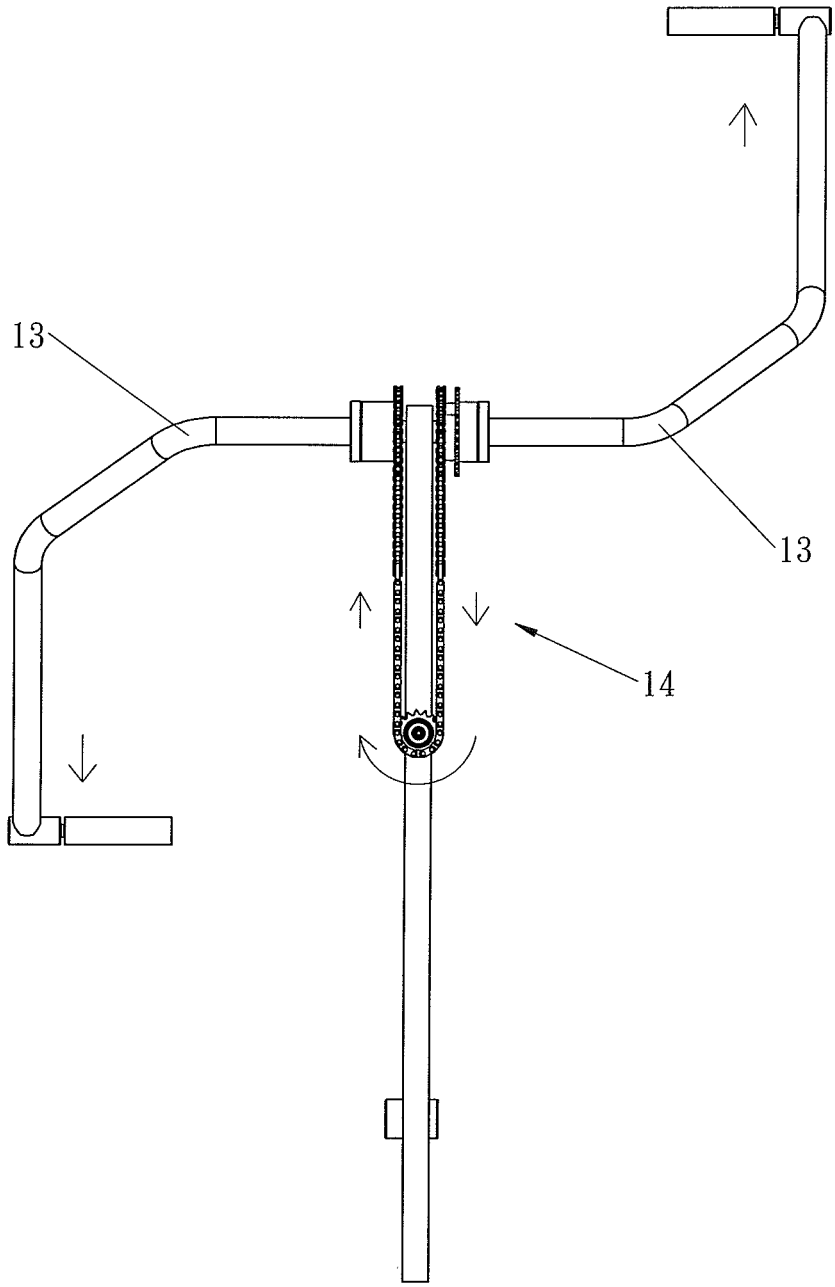
FIG. 8 is a partially side operational view of the rehabilitation exercising equipment as shown in FIG. 1.
Figure 9:
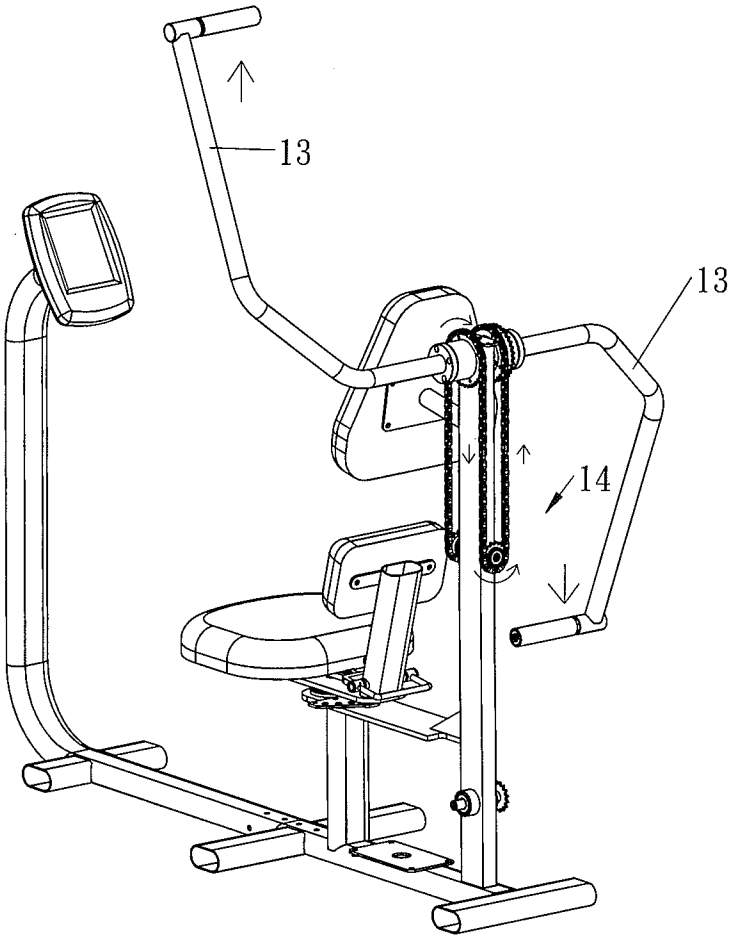
FIG. 9 is an operational view of the rehabilitation exercising equipment as shown in FIG. 1.
Figure 10:
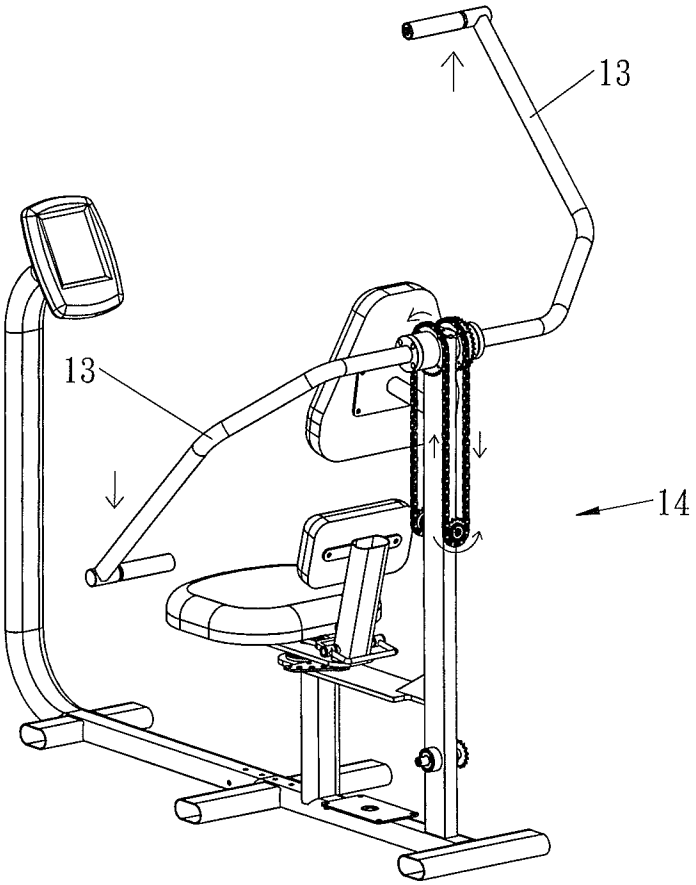
FIG. 10 is an operational view of the rehabilitation exercising equipment as shown in FIG. 1.
Figure 11:
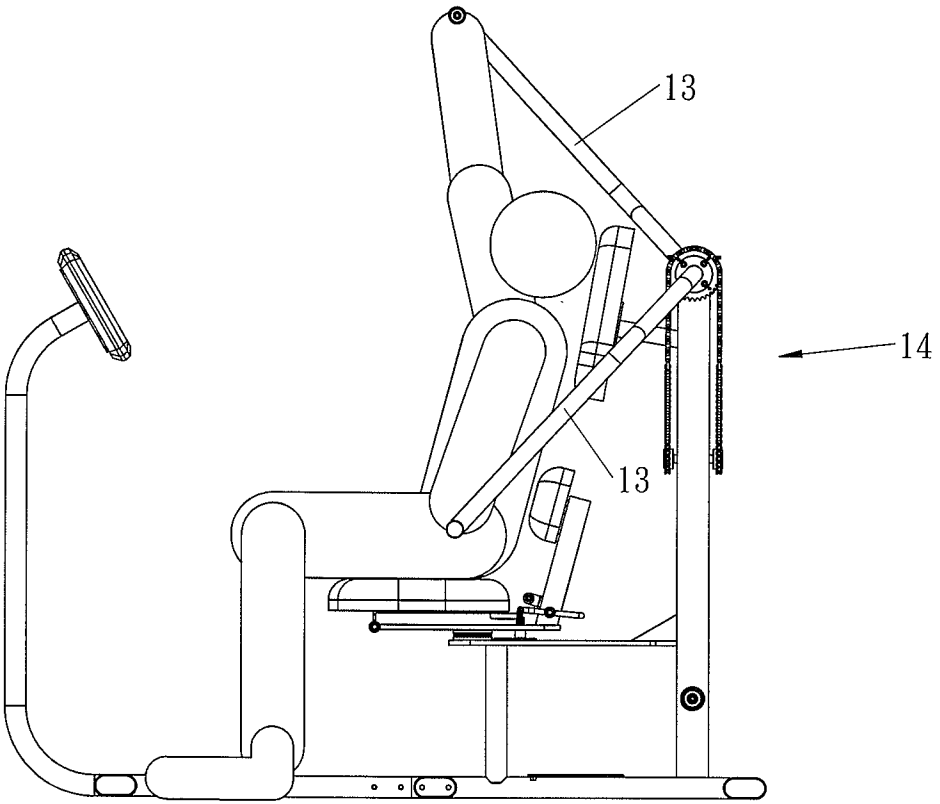
FIG. 11 is a front operational view of the rehabilitation exercising equipment as shown in FIG. 1.

In operation, referring to FIGS. 4-11 with reference to FIGS. 1-3, the connecting mechanism 14 is mounted between the first geared member 131, the second geared member 132, the first idle geared member 136 and the second idle geared member 137 so that the first geared member 131 and the second geared member 132 are moved in concert with each other and are moved in two opposite directions. In such a manner, the two handlebars 13 are pivoted about the upright post 12 of the main frame 10 in two opposite directions as shown in FIGS. 6-10. Thus, a user's two hands can hold the two handlebars 13 as shown in FIG. 11 to pivot the two handlebars 13 in two opposite directions by connection of the connecting mechanism 14 so as to achieve an exercising or rehabilitating function.

Figure 12:
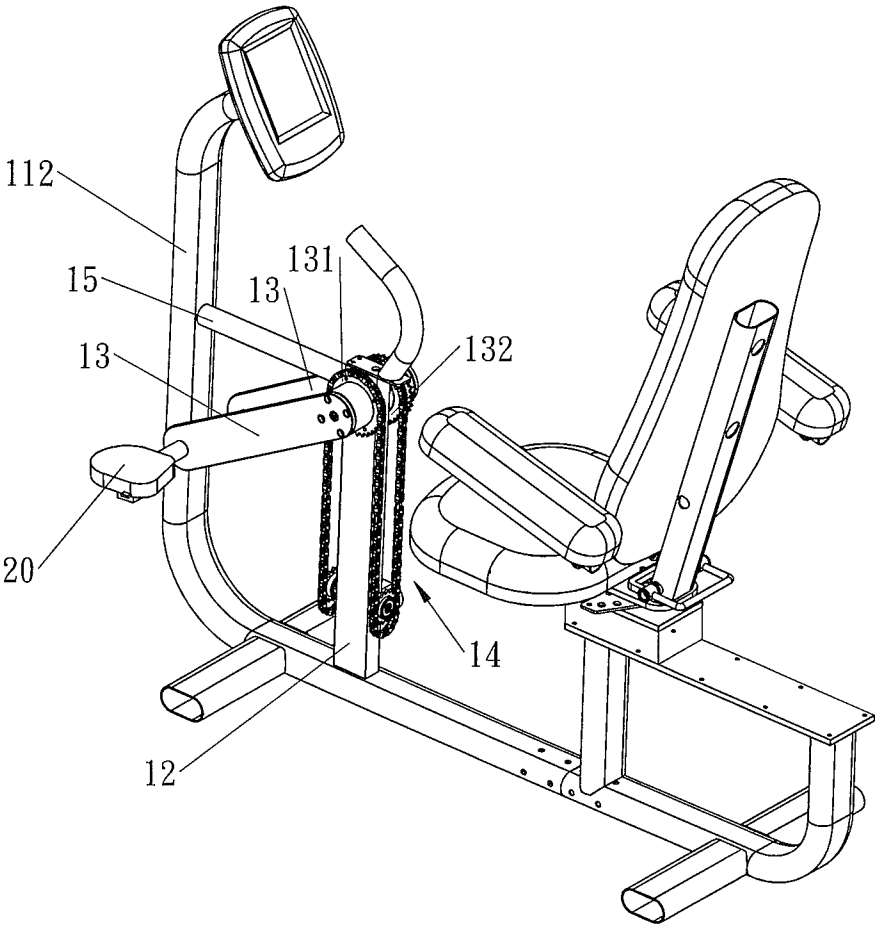
FIG. 12 is a perspective view of a rehabilitation exercising equipment in accordance with another preferred embodiment of the present invention.
Figure 13:
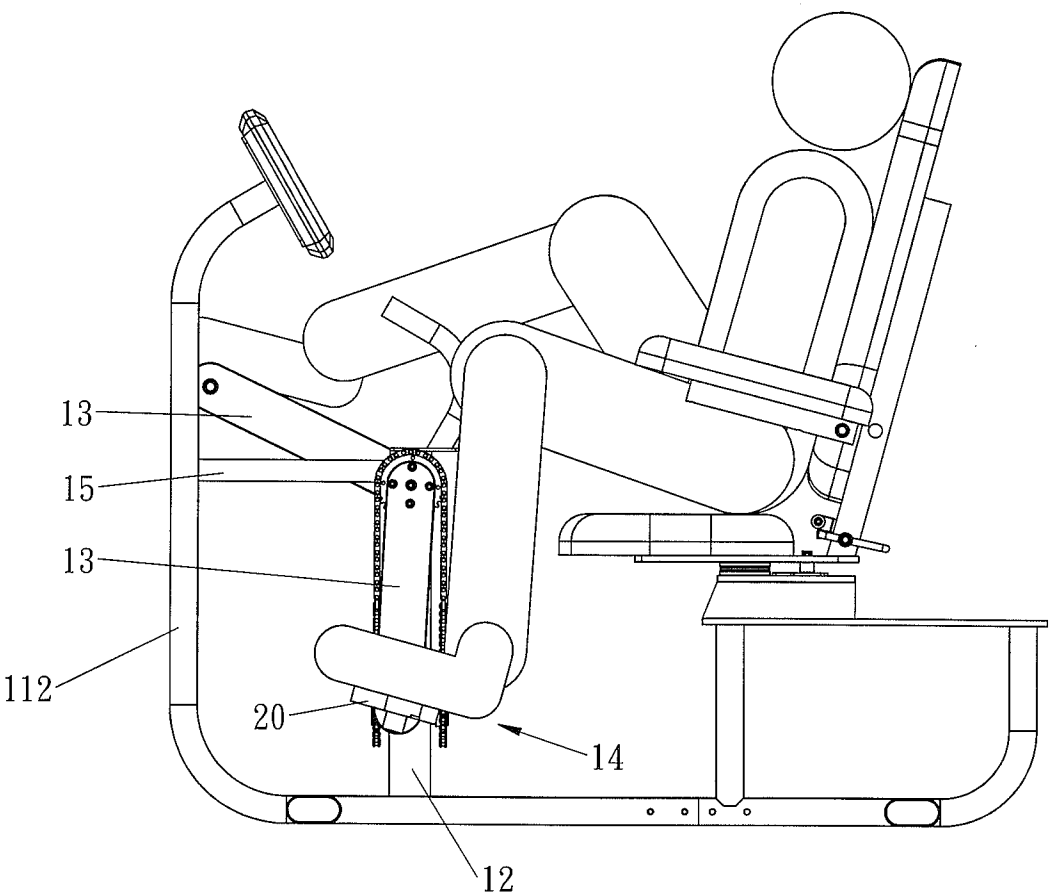
FIG. 13 is a front operational view of the rehabilitation exercising equipment as shown in FIG. 12.

Referring to FIGS. 12 and 13, the upright post 12 of the main frame 10 is connected with the extension bar 112 by a crossbar 15, and the rehabilitation exercising equipment further comprises two pedals 20 pivotally connected with the two handlebars 13 respectively. Each of the two handlebars 13 has a first end secured on one of the first geared member 131 and the second geared member 132 and a second end pivotally connected with one of the two pedals 20. Thus, the user's two legs can tread the two pedals 20 to drive the two handlebars 13 and to pivot the two handlebars 13 in two opposite directions by connection of the connecting mechanism 14 so as to achieve an exercising or rehabilitating function.

Figure 14:
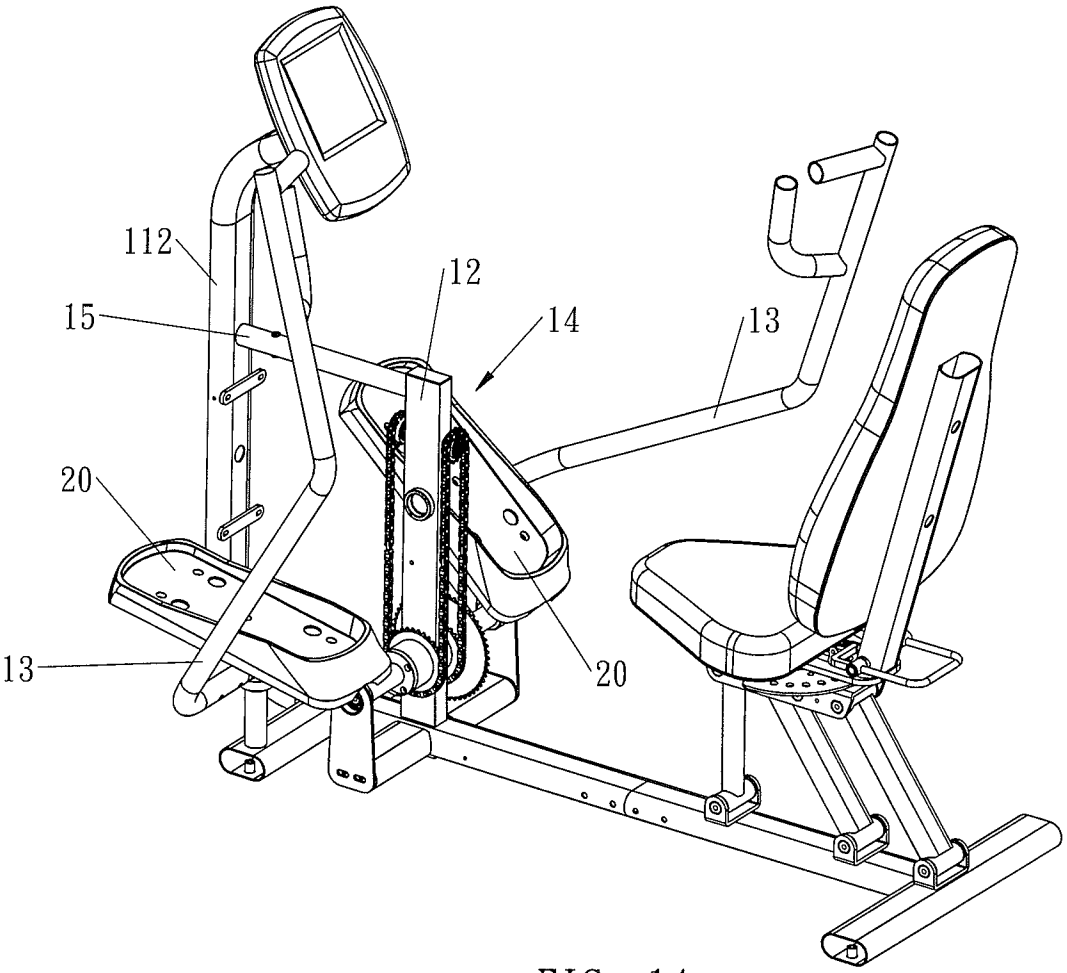
FIG. 14 is a perspective view of a rehabilitation exercising equipment in accordance with another preferred embodiment of the present invention.

Referring to FIG. 14, the two pedals 20 are moved in concert with the two handlebars 13 respectively. Thus, the user's two legs can tread the two pedals 20, and the user's two arms can hold the two handlebars 13.

Accordingly, a user's two hands can hold the two handlebars 13 to pivot the two handlebars 13 in two opposite directions by connection of the connecting mechanism 14 so as to achieve an exercising or rehabilitating function.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A rehabilitation exercising device, comprising:

a main frame;

a first geared member rotatably mounted on the main frame;

a second geared member rotatably mounted on the main frame;

a connecting mechanism mounted between the first geared member and the second geared member to connect the first geared member and the second geared member so that the first geared member and the second geared member are movable in concert with each other;

a first idle geared member rotatably mounted on the main frame and connected with the connecting mechanism;

a second idle geared member rotatably mounted on the main frame and connected with the connecting mechanism; and two handlebars secured on the first geared member and the second geared member to rotate in concert with the first geared member and the second geared member respectively;

wherein the connecting mechanism includes:

a first connecting portion meshing with the first geared member;

a second connecting portion meshing with the second geared member;

a third connecting portion meshing with the first idle geared member; and a fourth connecting portion meshing with the second idle geared member;

wherein the first connecting portion and the second connecting portion of the connecting mechanism are parallel with each other;

wherein the third connecting portion and the fourth connecting portion of the connecting mechanism are parallel with each other;

wherein each of the third connecting portion and the fourth connecting portion of the connecting mechanism traverses and connects the first connecting portion and the second connecting portion; and wherein the third connecting portion and the fourth connecting portion of the connecting mechanism are perpendicular to the first connecting portion and the second connecting portion.

2. The rehabilitation exercising device of claim 1, wherein the first connecting portion of the connecting mechanism has two distal ends;

the second connecting portion of the connecting mechanism has two distal ends;

the third connecting portion of the connecting mechanism has two distal ends pivotally connected with one of the two distal ends of the first connecting portion and one of the two distal ends of the second connecting portion;

the fourth connecting portion of the connecting mechanism has two distal ends pivotally connected with the other one of the two distal ends of the first connecting portion and the other one of the two distal ends of the second connecting portion.

3. The rehabilitation exercising device of claim 2, wherein the first connecting portion of the connecting mechanism has a substantially inverted U-shaped profile;

the second connecting portion of the connecting mechanism has a substantially inverted U-shaped profile;

the third connecting portion of the connecting mechanism has a substantially U-shaped profile;

the fourth connecting portion of the connecting mechanism has a substantially U-shaped profile.

4. The rehabilitation exercising device of claim 1, wherein the first geared member and the second geared member are parallel with each other;

the first idle geared member and the second idle geared member are parallel with each other;

the first idle geared member and the second idle geared member are perpendicular to the first geared member and the second geared member.

5. The rehabilitation exercising device of claim 1, wherein the connecting mechanism is connected between the first geared member, the second geared member, the first idle geared member and the second idle geared member.

6. The rehabilitation exercising device of claim 1, wherein the main frame includes a transverse bar, an upright post mounted on the transverse bar;

the first geared member and the second geared member are rotatably mounted on the upright post of the main frame;

the first idle geared member and the second idle geared member are rotatably mounted on the upright post of the main frame and are located under the first geared member and the second geared member.

7. The rehabilitation exercising device of claim 6, wherein the main frame further includes:

an extension bar connected with the transverse bar; and a control panel mounted on the extension bar.

8. The rehabilitation exercising device of claim 7, wherein the upright post of the main frame is connected with the extension bar by a crossbar.

9. The rehabilitation exercising device of claim 6, wherein the main frame further includes:

a support post mounted on the transverse bar;

a support plate mounted between the upright post and the support post;

a seat mounted on the support plate;

a back support mounted on the support plate;

a seat back mounted on the back support and located above the seat;

a back cushion mounted on the upright post and located above the seat back.

10. The rehabilitation exercising device of claim 1, wherein each of the two handlebars is pivotally mounted on the main frame.

11. The rehabilitation exercising device of claim 1, wherein the two handlebars are pivoted in two opposite directions by connection of the connecting mechanism.

12. The rehabilitation exercising device of claim 1, wherein the connecting mechanism is a toothed belt.

13. The rehabilitation exercising device of claim 1, wherein each of the first geared member, the second geared member, the first idle geared member and the second idle geared member is a sprocket;

the connecting mechanism is a chain.

14. The rehabilitation exercising device of claim 1, wherein the rehabilitation exercising equipment further comprises two pedals pivotally connected with the two handlebars respectively.

15. The rehabilitation exercising device of claim 14, wherein each of the two handlebars has a first end secured on one of the first geared member and the second geared member and a second end pivotally connected with one of the two pedals.

* * * * *